US006808413B2

(12) United States Patent
Plant et al.

(10) Patent No.: US 6,808,413 B2
(45) Date of Patent: Oct. 26, 2004

(54) QUICK RELEASE ELECTRICAL CONNECTOR

(75) Inventors: Tommy G. Plant, Winston-Salem, NC (US); Marc Schatell, Winston-Salem, NC (US)

(73) Assignee: B E Aerospace, Inc., Wellington, FL (US)

( * ) Notice: Subject to any disclaimer, the term of this patent is extended or adjusted under 35 U.S.C. 154(b) by 0 days.

(21) Appl. No.: 10/372,879

(22) Filed: Feb. 24, 2003

(65) Prior Publication Data

US 2004/0166728 A1 Aug. 26, 2004

(51) Int. Cl.[7] ..... H01R 13/60

(52) U.S. Cl. ..... 439/527; 439/34; 439/57; 439/546

(58) Field of Search ..... 439/527, 546, 439/57, 533, 34

(56) References Cited

U.S. PATENT DOCUMENTS 979,927 A * 12/1910 Blymyer ..... 439/546
5,769,661 A * 6/1998 Nealis ..... 439/551
5,888,093 A * 3/1999 Polgar et al. ..... 439/546
6,450,834 B1 * 9/2002 Polgar et al. ..... 439/546
6,540,385 B2 * 4/2003 Ikeda et al. ..... 362/512
6,626,699 B1 * 9/2003 Epe et al. ..... 439/527

OTHER PUBLICATIONS

Aero Electric, 10 pin Quick Release Bayonet Connector.

* cited by examiner

*Primary Examiner*—Truc T. T. Nguyen
(74) *Attorney, Agent, or Firm*—Adams Evans P.A.

(57) ABSTRACT

An electrical connector, including a first electrically-conductive connector element, a second electrically-conductive connector element for being mated with the first connector element for allowing electrical current to flow through the electrical connector from an upstream to a downstream side, and a retainer for receiving and carrying the first connector element. The retainer includes locking anchors for mounting the retainer into complementary locking ports in a mounting bracket whereby the electrical connector is releasably carried on the mounting bracket. The retainer includes a retainer flange on which the locking anchors are mounted. The second connector element includes a connector flange for being mounted on an opposite side of the mounting bracket from the retainer. The connector flange has holes therein for receiving the locking anchors.

15 Claims, 4 Drawing Sheets

QUICK RELEASE ELECTRICAL CONNECTOR

TECHNICAL FIELD AND BACKGROUND OF THE INVENTION

This invention relates to a quick release electrical connector. Connectors of this general type are used in many applications to releasably connect electrical apparatus to an electrical power source. The invention is described in this application with specific reference to use of the connector on an aircraft passenger seat. However, the invention has application in a wide range of uses, and by describing the invention in conjunction with one particular application, no inference is intended that the connector itself is useful only with regard to that one application.

Electrical connectors of the general type disclosed in this application include a pair of connection elements that releasably connect together. Most such connectors have bayonet-type locking elements so that the connector elements can be connected or disconnected by twisting one connector relative to the other. One connector element is typically connected to a source of electricity, with a complementary second connector element connected to an electrical apparatus, for example, an electric motor. In the passenger seat embodiment disclosed herein, these connectors are used to releasably connect various seat back, seat bottom and leg rest controls to the electrical system of the aircraft.

The connector is mounted in a bracket that in turn is mounted on a support so that the connector is stationary, positioned away from other surfaces and accessible when connection or disconnection is desired. Prior art connectors of this type are generally designed so that a first of the connector elements is mounted to the bracket, with the second connector element being held stationary by being locked to the first connector element.

The first connector element is often attached to the bracket by means of several small screws. For this reason, removal and replacement of the connector element is difficult and time-consuming. In many instances the connector is in a tight location that is difficult to access, such as under a seat. Moreover, there may be several such connectors under a single seat, and there are numerous seats in a single aircraft. A change-out of electrical apparatus in an entire aircraft or cabin thus requires a considerable amount of time. Dropped and lost screws can become jammed in track fittings or other seating elements and possibly affect seat operation.

The invention disclosed in this application permits quick removal or replacement of the connector or either connector element without tools and without time-consuming removal of multiple small screws in tight locations.

SUMMARY OF THE INVENTION

Therefore, it is an object of the invention to provide an electrical connector that can be quickly connected and disconnected.

It is another object of the invention to provide an electrical connector that can be connected and disconnected without tools.

It is another object of the invention to provide an electrical connector that can utilize existing connector elements and brackets.

It is another object of the invention to provide an electrical connector that includes a retainer that locks one electrical connector element to another without screws.

It is another object of the invention to provide an electrical connector that is integrally-formed and disposable.

These and other objects of the present invention are achieved in the preferred embodiments disclosed below by providing an electrical connector, comprising a first electrically-conductive connector element, a second electrically-conductive connector element for being mated with the first connector element for allowing electrical current to flow through the electrical connector from an upstream to a downstream side, and a retainer for receiving and carrying the first connector element. The retainer includes locking anchors for mounting the retainer into complementary locking ports in a mounting bracket whereby the electrical connector is releasably carried on the mounting bracket.

According to one preferred embodiment of the invention, the retainer includes a retainer flange on which the locking anchors are mounted, and the second connector element includes a connector flange for being mounted on an opposite side of the mounting bracket from the retainer. The connector flange has holes therein for receiving the locking anchors.

According to another preferred embodiment of the invention, the retainer includes a retainer flange on which four of the locking anchors are mounted in spaced-apart relation on four respective comers of the retainer flange.

According to yet another preferred embodiment of the invention, the retainer includes an annular collar having screw threads for mating with complementary screw threads carried on an exterior annular surface of the first connector element.

According to yet another preferred embodiment of the invention, the mounting bracket includes an annular opening for receiving the second connector element. A flange extends around and outwardly from the annular opening and a plurality of radially extending notches communicates with the annular opening for receiving complementary ones of the locking anchors.

According to yet another preferred embodiment of the invention, the retainer comprises a molded plastic material, and the locking anchors comprise integrally-molded, axially-extending studs.

According to yet another preferred embodiment of the invention, the studs are sized to be retained in the holes of the second connector element flange by means of a press fit.

According to yet another preferred embodiment of the invention, the electrical connector, comprises a first connector element and a second connector element for being mated with the first connector element for allowing electrical current to flow therethrough. A retainer receives and carries the first connector element, the ring including an annular collar within which the first connector element is adapted to be received. A retainer flange carries locking anchors thereon for mounting the locking means into complementary locking ports in a mounting bracket whereby the electrical connector is releasably carried on the mounting bracket. The mounting bracket includes an annular opening for receiving the second connector element. A flange extends around and outwardly from the annular opening and a plurality of radially extending notches communicates with the annular opening for receiving complementary ones of the locking anchors. The second connector element includes a connector flange for being mounted on an opposite side of the mounting bracket from the retainer. The connector flange has holes therein for receiving the locking anchors.

According to yet another preferred embodiment of the invention, a seat is provided having at least one electrically-operable apparatus associated therewith, and comprises a seat base carrying a seat back and seat bottom. A mounting bracket is mounted on the seat for mounting the electrical connector, and an electrical connector is carried by the mounting bracket for connecting the electrically operable apparatus to a source of electricity. The electrical connector comprises a first connector element, a second connector element for being mated with the first connector element for allowing electrical current to flow therethrough, and a retainer for receiving and carrying the first connector element. The ring includes an annular collar for receiving the first connector and a retainer flange carrying locking anchors thereon for mounting the locking means into complementary locking ports in the mounting bracket whereby the electrical connector is releasably carried on the mounting bracket. The mounting bracket includes an annular opening for receiving the second connector element, a flange extending around and outwardly from the annular opening and a plurality of radially extending notches communicating with the annular opening for receiving complementary ones of the locking anchors. The second connector element includes a connector flange for being mounted on an opposite side of the mounting bracket from the retainer. The connector flange has holes therein for receiving the locking anchors.

According to yet another preferred embodiment of the invention, the retainer comprises a molded plastic material, and the locking anchors comprise integrally-molded, axially-extending studs.

According to yet another preferred embodiment of the invention, the studs are sized to be retained in the holes of the second connector element flange by means of a press fit.

An embodiment of the method of mounting an electrical connector to a mounting bracket according to the invention comprises the steps of providing a first electrically-conductive connector element, a second electrically-conductive connector element for being mated with the first connector element for allowing electrical current to flow through the electrical connector from an upstream to a downstream side, and a retainer for receiving and carrying the first connector element. The retainer includes locking anchors for mounting the retainer into complementary locking ports in a mounting bracket whereby the electrical connector is releasably carried on the mounting bracket. The first connector element is attached to the retainer and the retainer is mounted to the mounting bracket by extending the locking anchors into the locking ports in the mounted bracket. The second connector element is attached to the first connector element.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
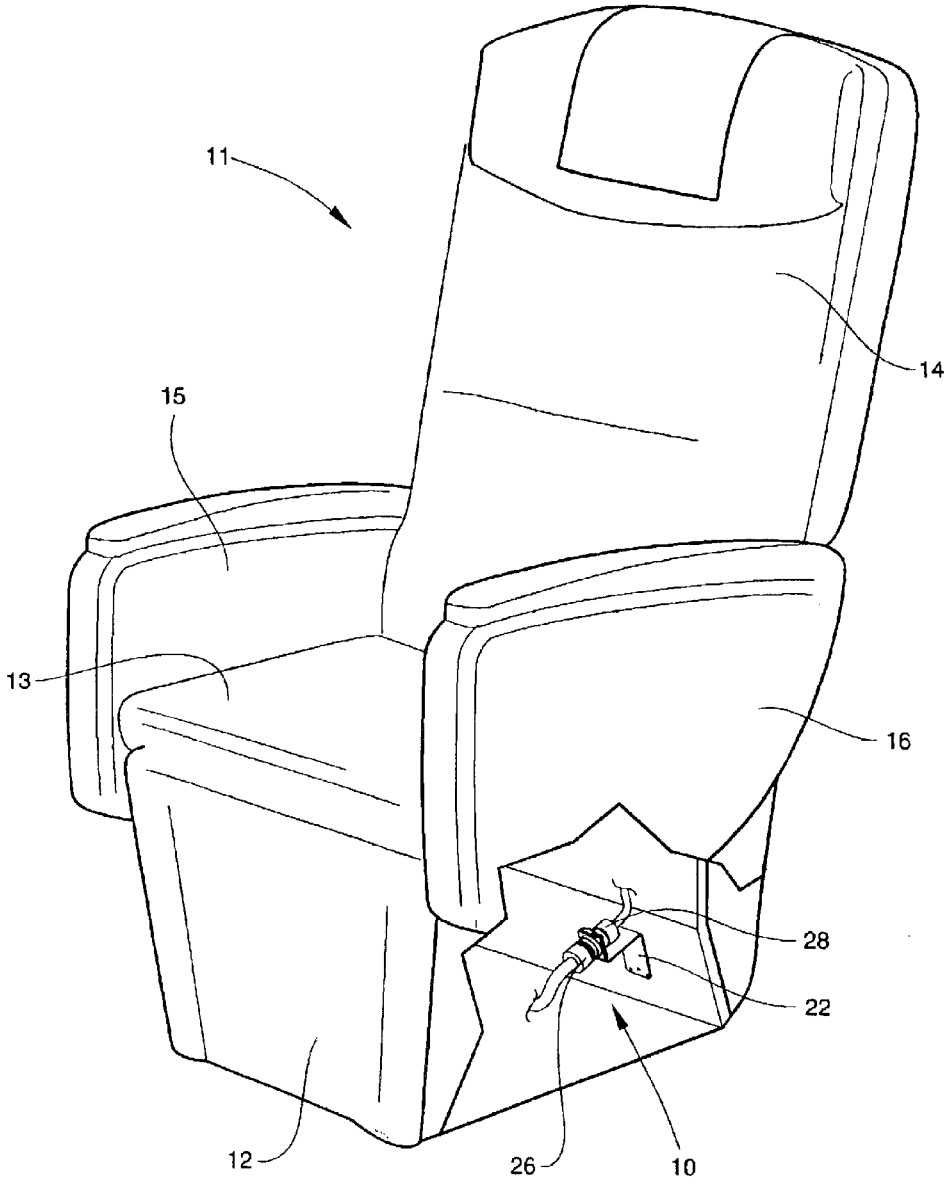
FIG. 1 is a perspective view with parts broken away of an aircraft passenger seat, showing an electrical connector according to an embodiment of the invention.

Referring now specifically to the drawings, an electrical connector according to the present invention is illustrated in FIG. 1 and shown generally at reference numeral 10. The electrical connector 10 is shown in a typical application on an aircraft passenger seat 11. The seat 11 includes a base 12, a seat bottom 13, a seat back 14, and a pair of opposed arm rests 15 and 16. In such an application the electrical connector 10 typically connects a source of electricity to an electrical apparatus, for example, an electric motor that controls a seat back, seat bottom or leg rest control to the electrical system of the aircraft.

Figure 2:
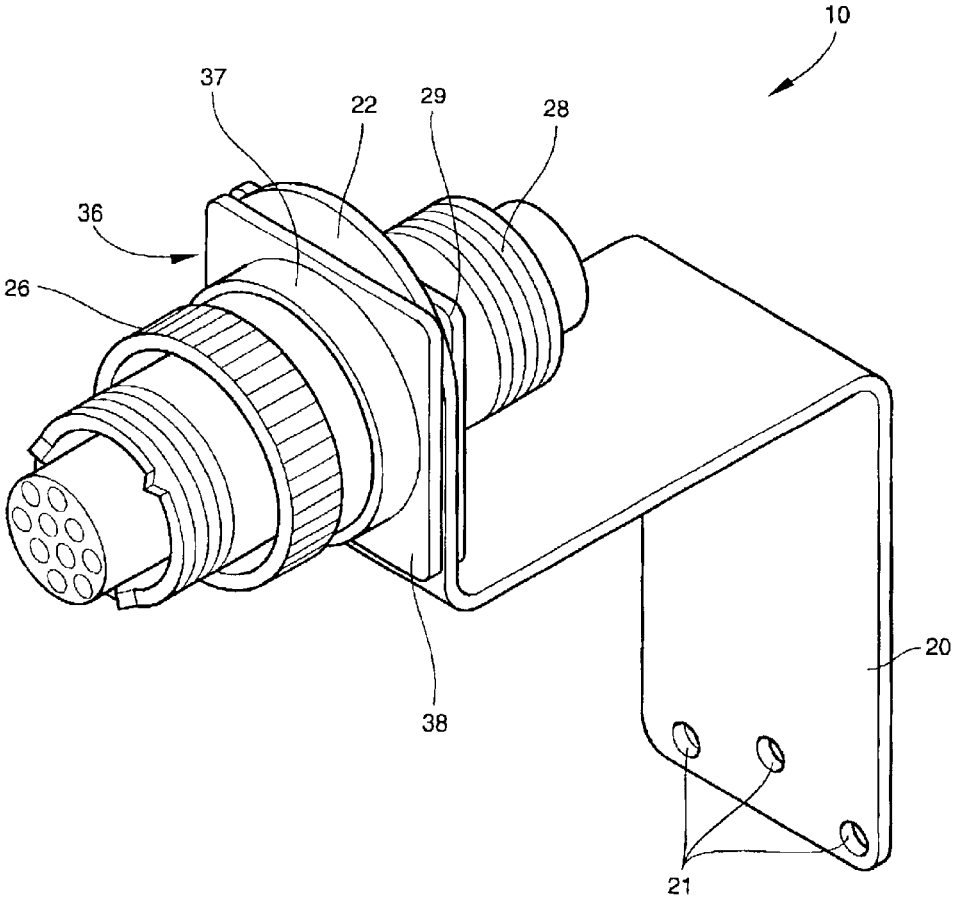
FIG. 2 is a perspective view of an electrical connector according to an embodiment of the invention, shown mounted to a mounting bracket.
Figure 3:
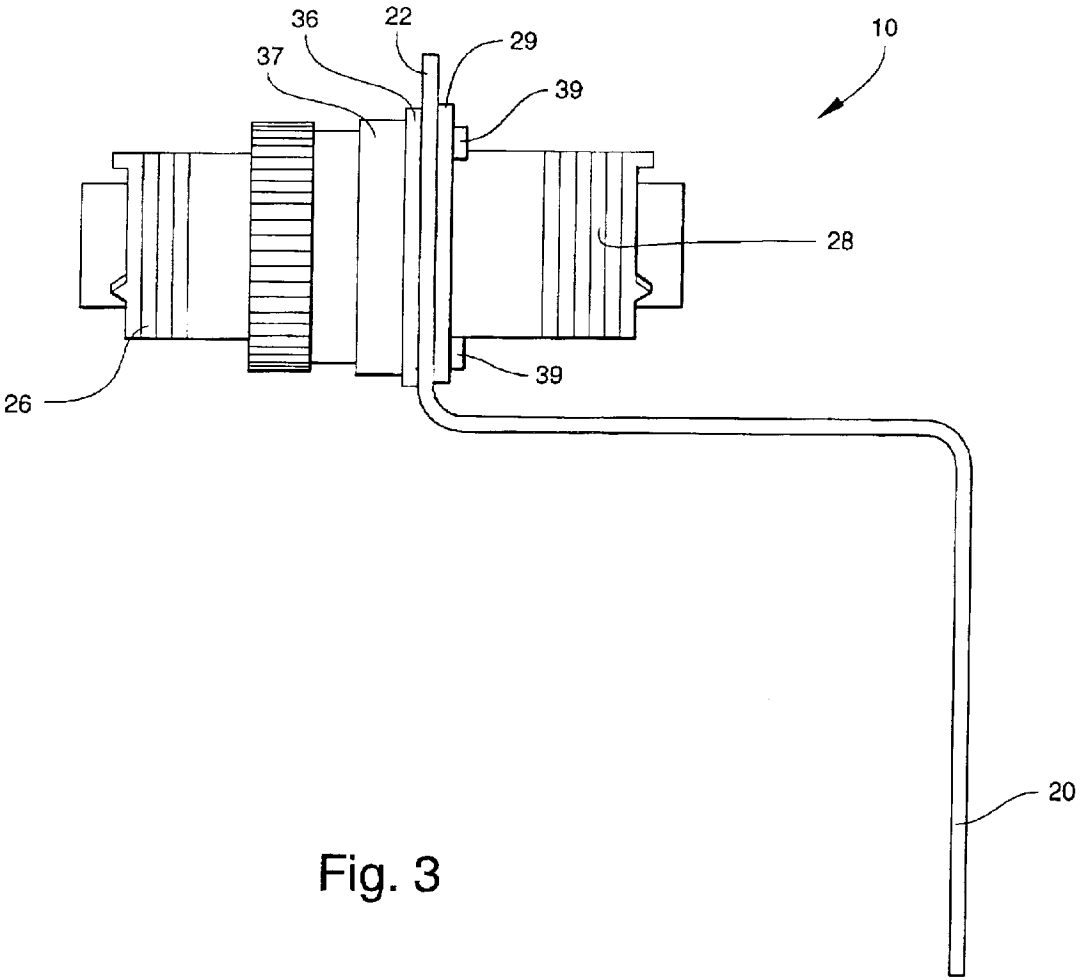
FIG. 3 is a side elevation of the electrical connector and mounting bracket shown in FIG. 2.
Figure 4:
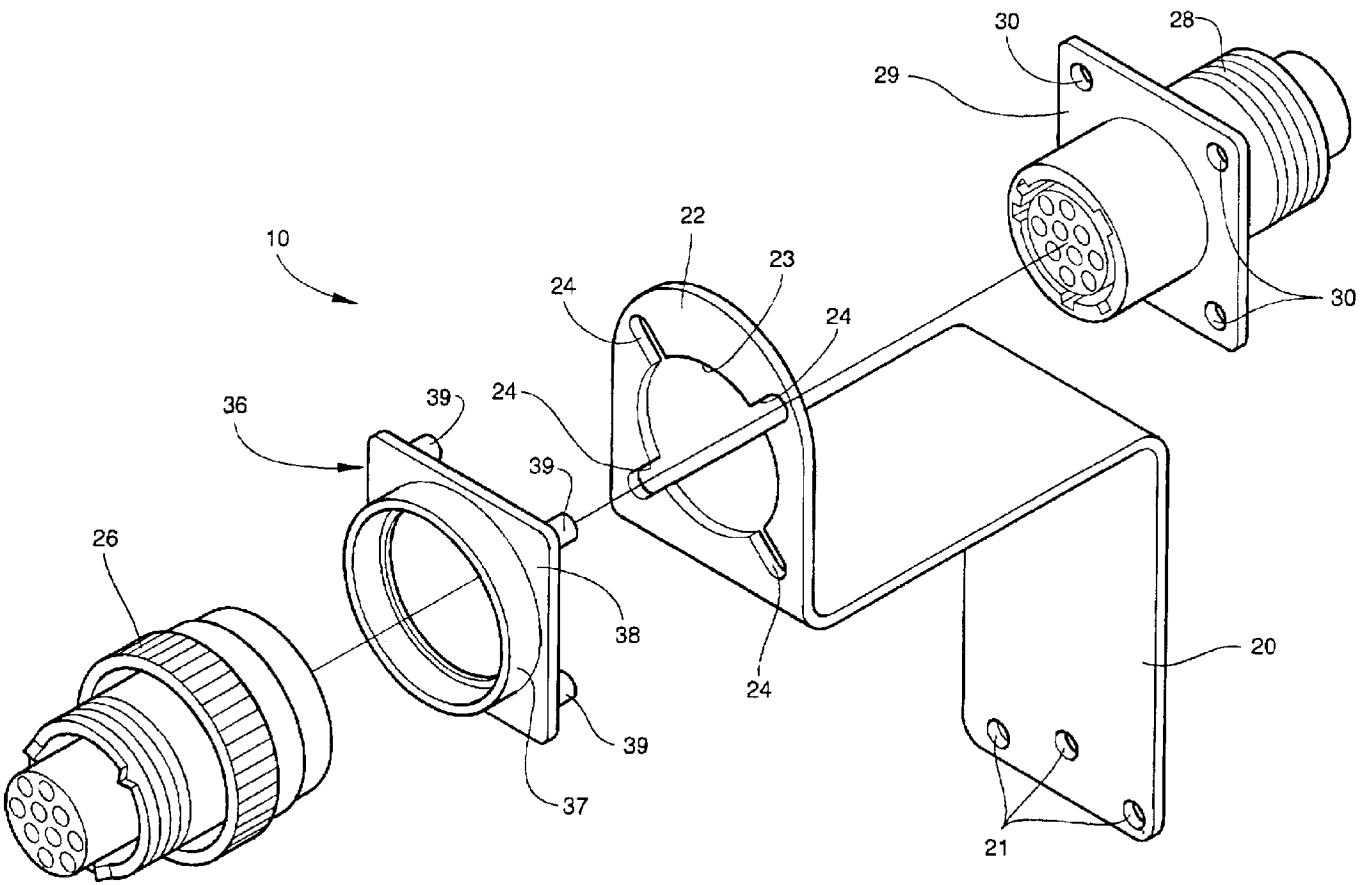
FIG. 4 is a perspective exploded view of the electrical connector and bracket shown in FIGS. 2 and 3.

Referring now to FIGS. 2, 3 and 4, the electrical connector 10 comprises a bracket 20 with holes 21 for mounting the bracket 20 to any suitable supporting structure. With particular reference to FIG. 4, the bracket 20 includes a mounting flange 22 in which is formed an annular opening 23 with four radially-extending notches 24 projecting outwardly from the annular opening 23. The shape of the bracket 20, including the means of mounting the bracket 20, and the length, bends and orientation of the bracket elements are dependent on the particular application.

The bracket mounting flange 22 retains three elements—a first connector element 26, a second connector element 28 and a retainer 36. The first connector element 26 is received within an annular retainer ring 37 of the retainer 36. The retainer ring 37 is integrally formed with a flange 38 having four axially-extending locking anchors in the form of studs 39, three shown. The retainer is preferably integrally-molded of a suitable plastic or nylon material, dependent on the particular application and compliance with any applicable regulations regarding the material and required use and strength characteristics.

The second connector element 28 conventionally mates with the first connector element 26 by means of, for example, a bayonet-type connector. The first connector element 26 and the second connector element 28 are thus twisted relative to each other in one direction to effect the connection and twisted in the opposite direction to effect a disconnection. The second connector element 28 includes a connector flange 29 with four holes 30, three shown.

As shown in FIGS. 2, 3 and 4, the retainer 36 is fitted to the bracket 20 by fitting the retainer 36 to the face of the mounting flange 22 with the four studs 39 fitted into respective ones of the four notches 24 of the mounting flange 22. Alternatively, individual holes can be formed in the mounting flange 22 that do not communicate with the annular opening 23.

The second connector element 28 is then mounted on the bracket 22 by fitting the studs 39 into the holes 30 in the connector flange 29 of the second connector element 28. The studs 39 and the holes 30 are preferably sized to form a press fit with each other, so that moderate pressure of the connector flange 29 against the bracket mounting flange 22 with the studs 39 aligned with the holes 30 releasably attaches the connector element 28 to the bracket flange 22, with the bracket mounting flange 22 sandwiched between the retainer 36 and the connector flange 29 of the second connector element 28.

The electrical connection is completed by aligning the first connector element 26 with the retainer 36 and the bayonet mounting elements of the second connector element 28, and twisting to effect the attachment. At this point the locking attachment of the first and second connection elements 26 and 28 maintains the integrity of the entire assembly, including the position of the retainer 36 against the bracket flange 22. No tools or other attachment elements are required to effect this connection.

When disconnection is required, the first connection element 26 can be removed from the remainder of the assembly twisting in the disconnection direction. If complete disassembly is desired, the second connection element 28 can be removed by pulling it axially away from the bracket flange 22 to withdraw the studs 39 from the holes 30 in the connector flange 29 of the second connection element 28.

An electrical connector is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. An electrical connector, comprising:

(a) a first electrically-conductive connector element;

(b) a second electrically-conductive connector element for being mated with the first connector element for allowing electrical current to flow through the electrical connector from an upstream to a downstream side; and (c) a retainer for receiving and carrying the first connector element, the retainer including a retainer flange having locking anchors mounted thereon for mounting the retainer into complementary locking ports in a mounting bracket whereby the electrical connector is releasably carried on the mounting bracket, wherein the second connector element includes a connector flange for being mounted on an opposite side of the mounting bracket from the retainer, said connector flange having holes therein for receiving the locking anchors.

2. An electrical connector according to claim 1, wherein four of said locking anchors are mounted in spaced-apart relation on four respective corners of the retainer flange.

3. An electrical connector according to claim 1, wherein the retainer includes an annular collar having screw threads for mating with complementary screw threads carried on an exterior annular surface of the first connector element.

4. An electrical connector according to claim 1, wherein the mounting bracket includes an annular opening for receiving the second connector element, a flange extending around and outwardly from the annular opening and a plurality of radially extending notches communicating with the annular opening for receiving complementary ones of the locking anchors.

5. An electrical connector according to claim 4, wherein the retainer comprises a molded plastic material, and further wherein the rocking anchors comprise integrally-molded, axially-extending studs.

6. An electrical connector according to claim 5, wherein the studs are sized to be retained in the holes of the second connector element flange by means of a press fit.

7. An electrical connector, comprising:

(a) a first connector element;

(b) a second connector element for being mated with the first connector element for allowing electrical current to flow therethrough;

(c) a retainer for receiving and carrying the first connector element, the ring including an annular collar within which the first connector element is adapted to be received, and a retainer flange carrying locking anchors thereon for mounting the locking means into complementary locking ports in a mounting bracket whereby the electrical connector is releasably carried on the mounting bracket:

(d) the mounting bracket including an annular opening for receiving the second connector element, a flange extending around and outwardly from the annular opening and a plurality of radially extending notches communicating with the annular opening for receiving complementary ones of the locking anchors; and (e) the second connector element including a connector flange for being mounted on an opposite side of the mounting bracket from the retainer, said connector flange having holes therein for receiving the locking anchors.

8. An electrical connector according to claim 7, wherein the retainer comprises a molded plastic material, and further wherein the locking anchors comprise integrally-molded, axially-extending studs.

9. An electrical connector according to claim 8, wherein the studs are sized to be retained in the holes of the second connector element flange by means of a press fit.

10. A seat having at least one electrically-operable apparatus associated therewith, and comprising:

(a) a seat base carrying a seat back and seat bottom;

(b) a mounting bracket mounted on the seat for mounting the electrical connector;

(c) an electrical connector carried by the mounting bracket for connecting the electrically operable apparatus to a source of electricity, the electrical connector comprising:

(d) a first connector element;

(e) a second connector element for being mated with the first connector element for allowing electrical current to flow therethrough;

(f) a retainer for receiving and carrying the first connector element, the ring including an annular collar for receiving the first connector element and a retainer flange carrying locking anchors thereon for mounting the locking means into complementary locking ports in the mounting bracket whereby the electrical connector is releasably carried on the mounting bracket;

(g) the mounting bracket including an annular opening for receiving the second connector element, a flange extending around and outwardly from the annular opening and a plurality of radially extending notches communicating with the annular opening for receiving complementary ones of the locking anchors; and (h) the second connector element including a connector flange for being mounted on an opposite side of the mounting bracket from the retainer, said connector flange having holes therein for receiving the locking anchors.

11. An electrical connector according to claim 10, wherein the retainer comprises a molded plastic material, and further wherein the locking anchors comprise integrally-molded, axially-extending studs.

12. An electrical connector according to claim 11, wherein the studs are sized to be retained in the holes of the second connector element flange by means of a press fit.

13. A retainer for an electrical connector, and comprising:

(a) an annular ring collar for receiving and carrying a first connector element of an electrical connector; and (b) the retainer having locking anchors for mounting the retainer into complementary locking ports in a mounting bracket whereby the electrical connector is releasably carried on the mounting bracket, wherein the locking anchors are adapted to releasably mate with complementary holes formed in a second connector element releasably attached to the first connector element.

14. A retainer according to claim 13, wherein the locking anchors comprise axially projecting studs carried on a flange surrounding the retainer collar.

15. A retainer according to claim 13, wherein the locking anchors and the flange are integrally-formed with the retainer collar.

* * * * *